US009938078B2

(12) United States Patent
Yamada

(10) Patent No.: US 9,938,078 B2
(45) Date of Patent: Apr. 10, 2018

(54) PUSHING TYPE LID OPENING/CLOSING DEVICE OF A CONTAINER AND A PUSHING TYPE LID OPENING/CLOSING UNIT

(75) Inventor: Masahito Yamada, Tokyo (JP)

(73) Assignee: SUGATSUNE KOGYO CO. LTD., Tokyo (JP)

( * ) Notice: Subject to any disclaimer, the term of this patent is extended or adjusted under 35 U.S.C. 154(b) by 95 days.

(21) Appl. No.: 12/797,639

(22) Filed: Jun. 10, 2010

(65) Prior Publication Data

US 2010/0314403 A1 Dec. 16, 2010

(30) Foreign Application Priority Data

Jun. 16, 2009 (JP) ..... 2009-143699

(51) Int. Cl.

| | |
|---|---|
| ***B65F 1/14*** | (2006.01) |
| ***B65F 1/16*** | (2006.01) |
| *A47G 29/22* | (2006.01) |
| *B65F 1/00* | (2006.01) |
| *B65F 1/12* | (2006.01) |

(52) U.S. Cl.

CPC ..... *B65F 1/1623* (2013.01); *A47G 29/22* (2013.01); *B65F 1/00* (2013.01); *B65F 1/12* (2013.01); *B65F 1/141* (2013.01); *B65F 1/1607* (2013.01); *B65F 2001/1692* (2013.01); *Y10S 220/908* (2013.01)

(58) Field of Classification Search

CPC ... A47G 29/22; B65F 1/12; B65F 1/00; B65F 1/141; B65F 1/1607; B65F 1/1623; B65F 2001/1692; Y10S 220/908

USPC .... 220/825, 827, 829, 830, 908, 242, 254.3, 220/908.1, 908.3, 495.01, 495.06, 495.08; 49/383, 400, 504; 160/369; 193/2 A, 34; 232/44; 248/310

See application file for complete search history.

(56) References Cited

U.S. PATENT DOCUMENTS

| | | | | |
|---|---|---|---|---|
| 1,701,499 | A * | 2/1929 | Howle | 193/34 |
| 1,864,538 | A * | 6/1932 | Hauser | 220/825 |
| 2,297,757 | A * | 10/1942 | Field, Jr. | 236/45 |
| 3,300,900 | A * | 1/1967 | Risk et al. | 49/381 |
| 3,306,486 | A * | 2/1967 | Martino et al. | 220/254.3 |
| 3,554,345 | A * | 1/1971 | Mullens | 193/33 |
| 3,704,825 | A * | 12/1972 | Hinohara et al. | 232/44 |
| 3,713,581 | A * | 1/1973 | Mullens | 232/1 E |
| 3,901,139 | A * | 8/1975 | Moriconi | 100/48 |
| 4,079,548 | A * | 3/1978 | Zaccaria | 49/67 |

(Continued)

FOREIGN PATENT DOCUMENTS

| | | | | |
|---|---|---|---|---|
| EP | 443601 A1 * | 8/1991 | | B65F 1/08 |
| JP | 52055683 U1 | 10/1975 | | |

(Continued)

*Primary Examiner* — J. Gregory Pickett
*Assistant Examiner* — Elizabeth Volz
(74) *Attorney, Agent, or Firm* — Pearne & Gordon LLP

(57) ABSTRACT

A pushing type lid 20 of a container is pivotally supported adjacent to an upper edge wall of an opening 2 of width smaller than width of a front board 1BF of a box body 1B and adapted to be manually pushed inwards so as to be opened and to be automatically closed when a hand is released from the lid 20 and there is provided a pair of hand and/or finger catch prevention wall member 50 to prevent a hand and/or fingers from being caught between the lid 20 and the wall face of the opening 2.

6 Claims, 22 Drawing Sheets

(56) References Cited

U.S. PATENT DOCUMENTS

| | | | | | |
|---|---|---|---|---|---|
| D270,677 | S | * | 9/1983 | Creske | D34/8 |
| 4,609,122 | A | * | 9/1986 | Ziegenbein | 220/211 |
| 4,663,885 | A | * | 5/1987 | Stibolt | 49/67 |
| 4,991,350 | A | * | 2/1991 | Kirk | 49/169 |
| 5,011,026 | A | * | 4/1991 | Hausman et al. | 209/675 |
| 5,156,291 | A | * | 10/1992 | Mielke | 220/254.5 |
| 5,183,175 | A | * | 2/1993 | Brown | 220/23.87 |
| 5,372,271 | A | * | 12/1994 | Miller et al. | 220/263 |
| 5,603,142 | A | * | 2/1997 | Dubach et al. | 16/247 |
| 5,806,759 | A | * | 9/1998 | Axisa | 232/44 |
| D414,908 | S | * | 10/1999 | Mockett | D34/10 |
| 6,385,909 | B1 | * | 5/2002 | Marsh et al. | 49/169 |
| 7,021,527 | B2 | * | 4/2006 | Repic et al. | 232/44 |
| 7,419,087 | B2 | * | 9/2008 | Owen | 232/44 |
| 2003/0106898 | A1 | * | 6/2003 | Kennedy et al. | 220/825 |
| 2006/0060594 | A1 | * | 3/2006 | Peacemaker | 220/825 |
| 2006/0102639 | A1 | * | 5/2006 | Lubbe | 220/825 |
| 2010/0314403 | A1 | * | 12/2010 | Yamada | 220/825 |

FOREIGN PATENT DOCUMENTS

| | | | | | |
|---|---|---|---|---|---|
| JP | 2-105901 | U1 | | 8/1990 | |
| JP | 3-45851 | U1 | | 4/1991 | |
| JP | 05338703 | A | * | 12/1993 | B65F 1/16 |
| JP | 200468507 | | | 3/2004 | |

* cited by examiner

PUSHING TYPE LID OPENING/CLOSING DEVICE OF A CONTAINER AND A PUSHING TYPE LID OPENING/CLOSING UNIT

FIELD OF THE INVENTION

This invention relates to a pushing type lid opening/closing device of a container provided in an opening of a container such as a dust box and a pushing type lid opening/closing unit to be attached to an attachment port of a container. More particularly, this invention relates to a device and a unit adapted to open/close a pushing type lid pivotally supported on a wall of an opening having a width smaller than that of a front board of the container.

BACKGROUND OF THE INVENTION

Summary of the Invention

Generally, a lid of a dust box (a container) (see a numeral 19 of JP2-105901U1 and a numeral 5 of JP3-45851U1) is pivotally supported on an upper edge wall of an opening having a width smaller than that of a front face of a box body and is adapted to be opened with its pivotal movement at the upper edge by being manually pushed inwards. As the user's hand is released from the lid, it is automatically closed by a spring, a weight and/or gravity.

However, the container having such a pushing type lid opening/closing device according to the prior art has a disadvantages that when the user pushes the lid by its hand and then released from the lid in order to dump dust (or waste) such as garbage into the dust box, the hand tends to be held between side edges of the lid and the wall face of the opening of the container so that the hand and/or the fingers cannot be removed out of them by being caught between them and are damaged in the worst

SUMMARY OF THE INVENTION

It is an object of the invention to provide a pushing type lid opening/closing device of a container adapted to prevent a hand and/or fingers from being caught between the side edges of the lid and the wall face of the opening of the container so that the prevention of their removal is never made and also their damage can be effectively prevented.

It is another object of the invention to provide a pushing type lid opening/closing unit of a container adapted to be attached to a wall of an opening of the container and to prevent a hand and/or fingers from being caught between the side edges of the lid and the wall face of the opening of the container so that the prevention of their removal is never made and also their damage can be effectively prevented.

In accordance with a first aspect of the invention, there is provided a pushing type lid opening/closing device of a container attached to a portion adjacent to an edge of an opening having a width smaller than that of a front board of a box body of said container and adapted to be opened by being manually pushed inwards and automatically closed when a hand is released from said lid, characterized by comprising a pair of hand and/or fingers catch prevention wall members for preventing said hand and/or fingers from being caught between said lid and a wall face of said opening of said box body.

In the aforementioned first aspect of the invention, the lid opening/closing device may comprise an attachment frame having an opening corresponding to an attachment port of said box body and to be attached to said front board of said box body and a lid pivotal support portion provided in an upper edge portion of said opening of said attachment frame to pivotally support said lid, said hand and/or fingers catch prevention wall members may be attached to said attachment frame separately from said attachment frame or integrally with said attachment frame.

The attachment frame may preferably have a pair of screwing pieces provided on both sides of the attachment frame to be screwed to an inner face of the attachment port wall of the box body while the hand and/or finger catch prevention wall members may preferably have a screw driver penetration hole corresponding to a screw hole of said screwing pieces.

Although the hand and/or finger catch prevention wall members may be desirably closer to the side edge of the lid to such an extent that the hand and/or finger catch prevention wall members never disturb the opening and/or closing of the lid, there may be an space between them unless the fingers are caught between them relative to the side edge of the lid.

In this case, a distance between the hand and/or finger catch prevention wall members and the lid in the widthwise direction of the attachment frame may be set to be equal to or smaller than a distance between the side edges of the opening of the attachment frame and the side edges of the lid.

In accordance with a second aspect of the invention, there is provided a pushing type lid opening/closing unit characterized by comprising an attachment frame having an opening corresponding to an attachment port of a box body of a container and of width smaller than a width of a front board of said box body, a lid to open and/or close said opening, a lid pivotal support portion provided on an upper edge wall of said opening of said attachment frame so as to pivotally support said lid and a pair of hand and/or finger catch prevention wall members to prevent a hand and/or fingers from being caught between said lid and an wall face of said opening of said attachment frame.

In the aforementioned second aspect of the invention, the hand and/or finger catch prevention wall members may be attached to the attachment frame or formed integrally with the attachment frame.

The attachment frame may preferably have a pair of screwing pieces provided on both sides of the attachment frame to be screwed to an inner face of the attachment port wall of the box body while the hand and/or finger catch prevention wall members may preferably have a screw driver penetration hole corresponding to a screw hole of said screwing pieces.

Although the hand and/or finger catch prevention wall members may be desirably closer to the side edge of the lid to such an extent that the hand and/or finger catch prevention wall members never disturb the opening and/or closing of the lid, there may be an space between them unless the fingers are caught between them relative to the side edge of the lid.

In this case, a distance between the hand and/or finger catch prevention wall member and the lid in the widthwise direction of the attachment frame may be set to be equal to or smaller than a distance between the side edge of the opening of the attachment frame and the side edge of the lid.

Since the lid opening/closing device of the invention is provided with the hand and/or finger catch prevention wall members to prevent the hand and/or fingers from being caught between the lid and the wall face of the opening of the container or of the opening of the attachment frame of the lid opening/closing unit attached to the attachment port of the container to form the opening of the container, the hand and/or the fingers are never caught between the lid and the wall face of the opening when the hand is released from the lid after it pushes the lid inwards. Thus, the hand and/or the fingers can be positively prevented from being caught between them and therefore they are never damaged.

Even if the screwing pieces to attach the attachment frame to the attachment port of the box body are outside of the hand and/or finger catch prevention wall members, the attachment frame can be attached by inserting a screw driver through the screw driver penetration hole in the hand and/or finger catch prevention wall members and therefore there occurs no trouble in the operation of attachment of the lid.

BRIEF DESCRIPTION OF THE DRAWINGS

FIG. 4 illustrates the device of FIG. 3 in a cross sectional view taken along the line B-B of FIG. 3 in which FIG. 4(A) is a whole cross sectional view and FIG. 4(B) is an enlarged cross sectional view of a right side end thereof;

DESCRIPTION OF PREFERRED EMBODIMENTS

Figure 1:
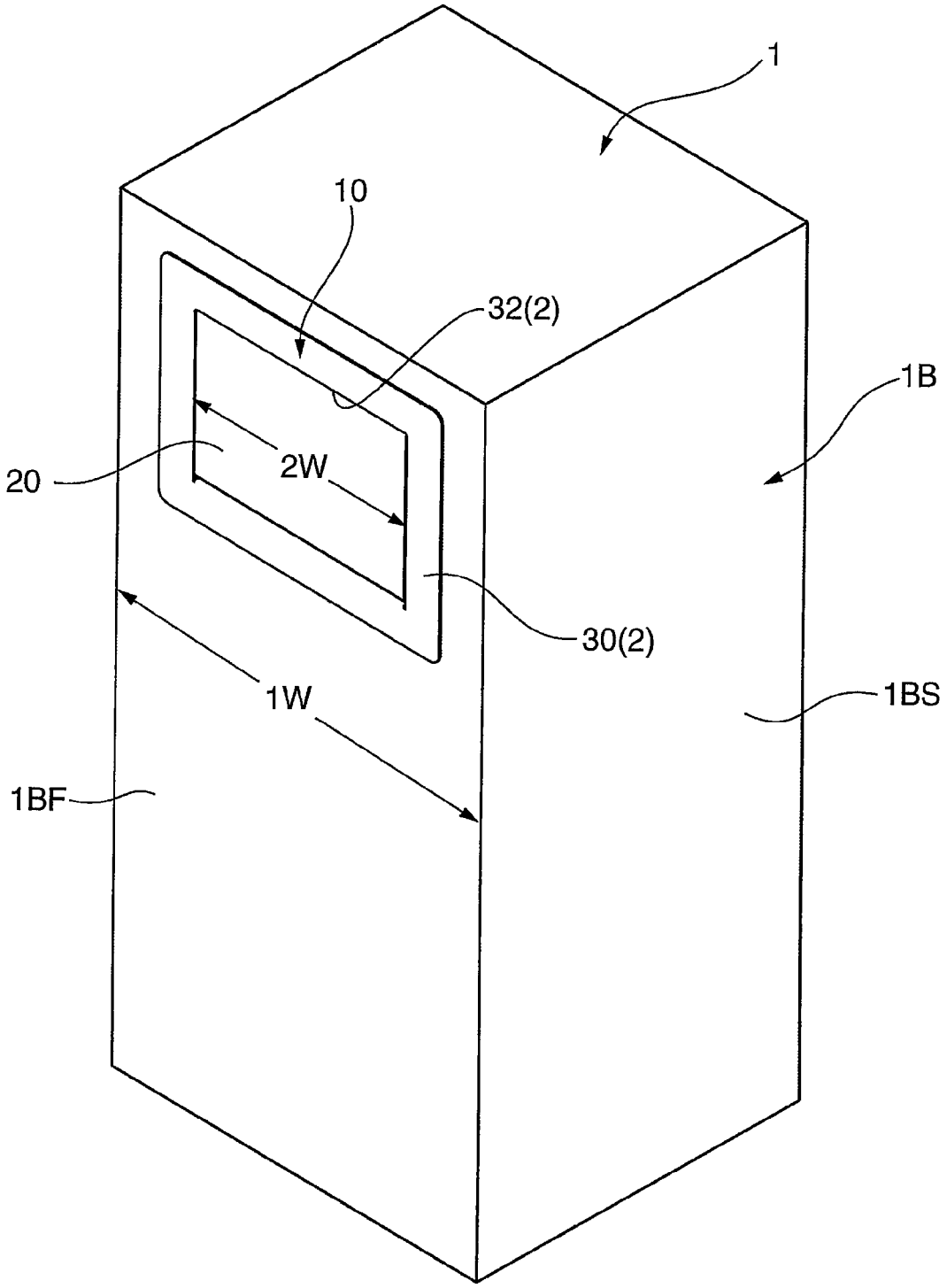
FIG. 1 is a perspective view of a container in the form of a dust box provided with a pushing type lid opening/closing device of the invention in the state where the lid is closed.
Figure 2:
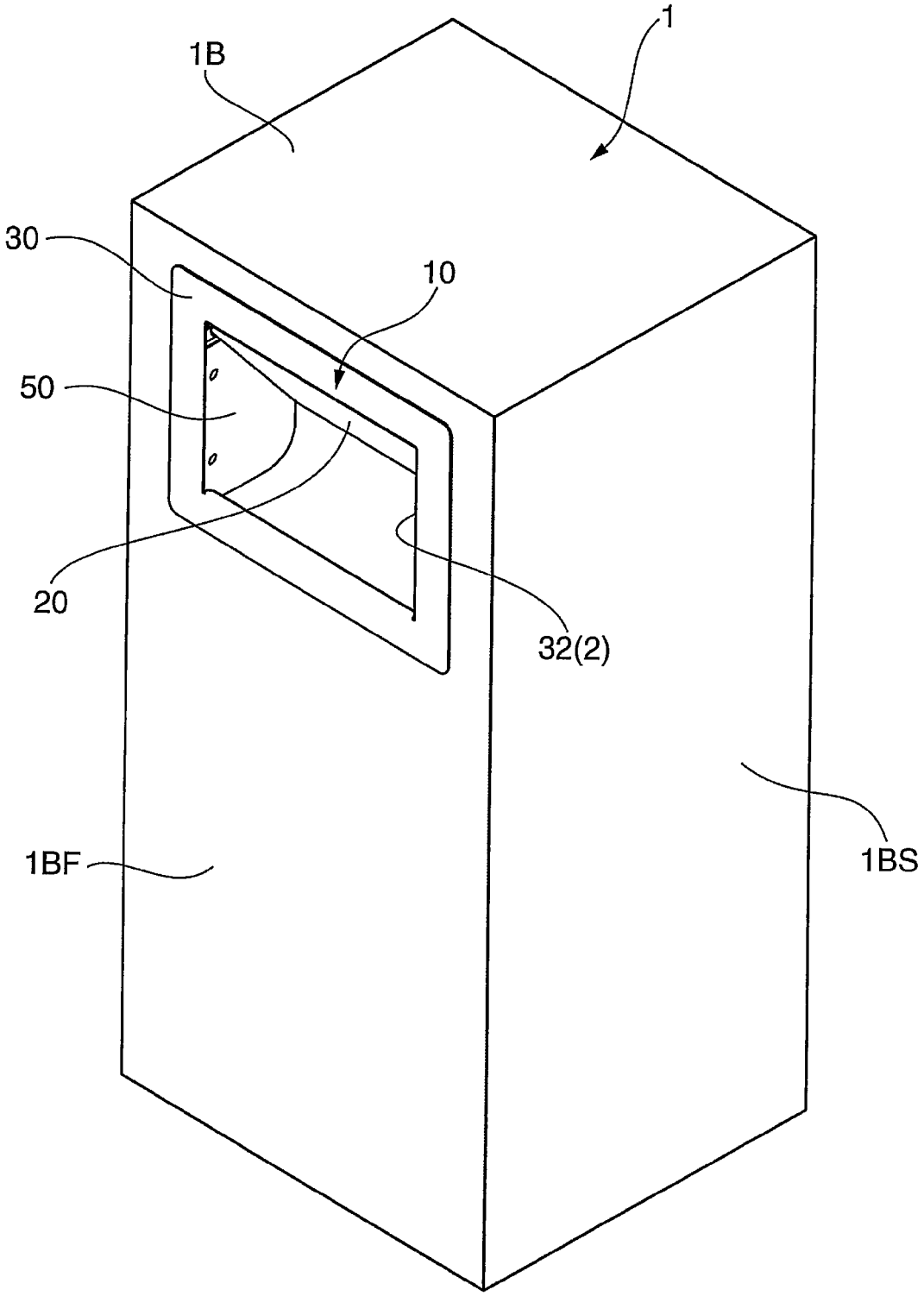
FIG. 2 is a perspective view of the container of FIG. 1 in the lid half-opened state.

Describing one form of embodiment of the invention with reference to FIGS. 1 through 20, FIGS. 1 through 4 illustrate a container. 1 in the form of a dust box provided with a pushing type lid opening/closing device 10 of the invention. The container 1 comprises a box body 1B in the form of a square pillar and an opening 2 of the box body 1B through which dust is to enter (in the illustrated form, the opening 2 is not an opening of the box body 1B, but an opening of an attachment frame of a lid opening/closing unit 10B to be attached to an attachment port 1BH of the box body 1B as described later) has a width 2W smaller than the width 1W of a front board 1BF of the box body 1B, that is a distance between both side board 1BS.

The pushing type lid opening/closing device 10 according to a desirable form of embodiment of the invention may comprise a pushing type lid opening/closing unit 10U attached to the attachment port 1BH of the box body 1B of the container 1 by screwing in a manner independent from the container 1.

The pushing type lid opening/closing unit 10U comprises a lid 20 for opening and closing the opening 2 of the container 1 (namely, the opening of the attachment frame described later), the attachment frame 30 having an opening 32 for forming the opening 2 of the container 1 to be attached to the front board 1BF of the box body 1B, and a lid pivotal support portion 40 provided on the upper edge wall of the opening 32 of the attachment frame 30 (the opening 2 of the container. 1) to pivotally support the lid 20.

The box body 1B, the lid 20 and the attachment frame 30 may be made of wood, plastic, metal or a combination of two more thereof. For example, the box body 1B may be made of wood and the lid 2 and the attachment frame 30 may be made of metal.

Figure 4:
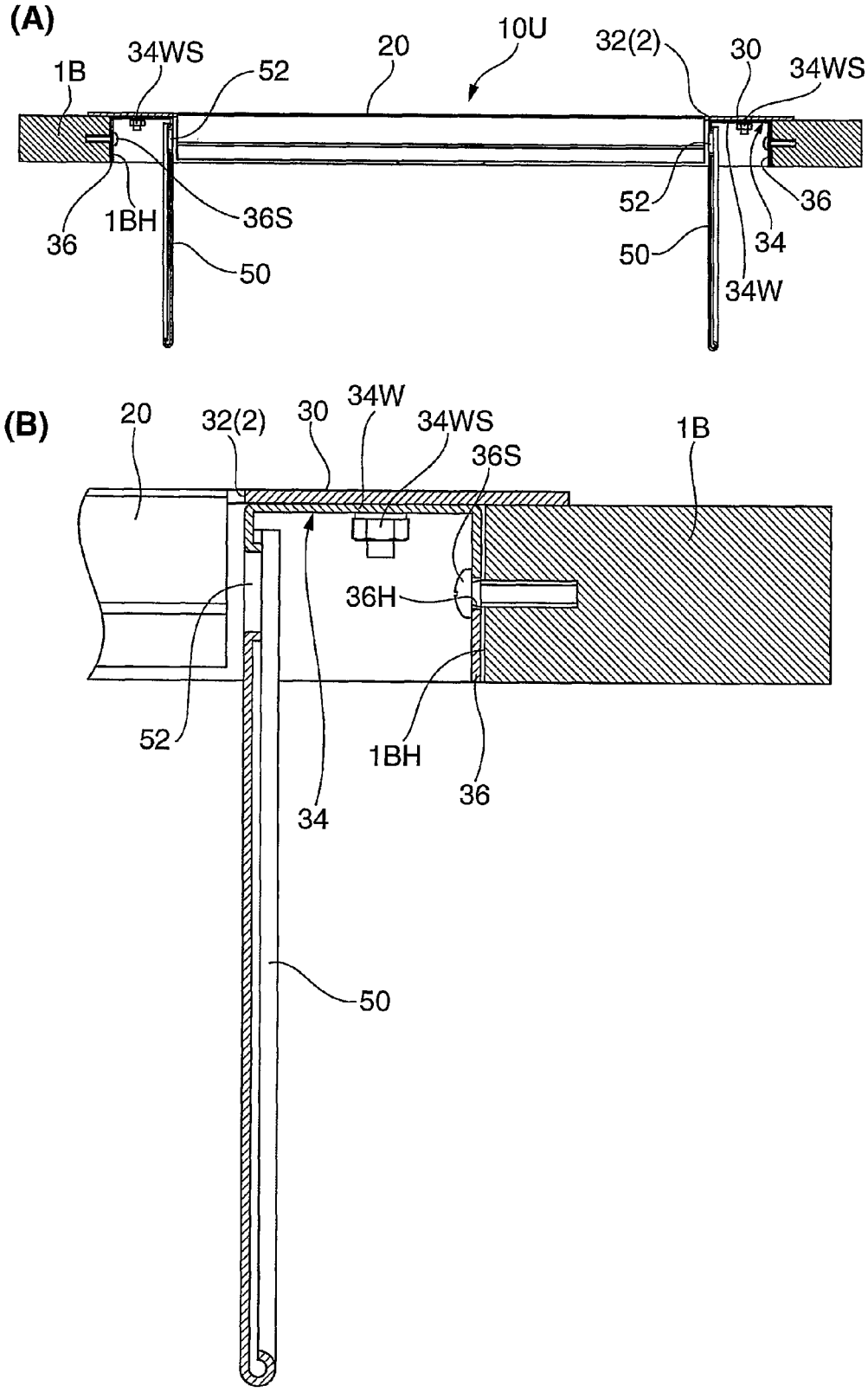
Figure 5:
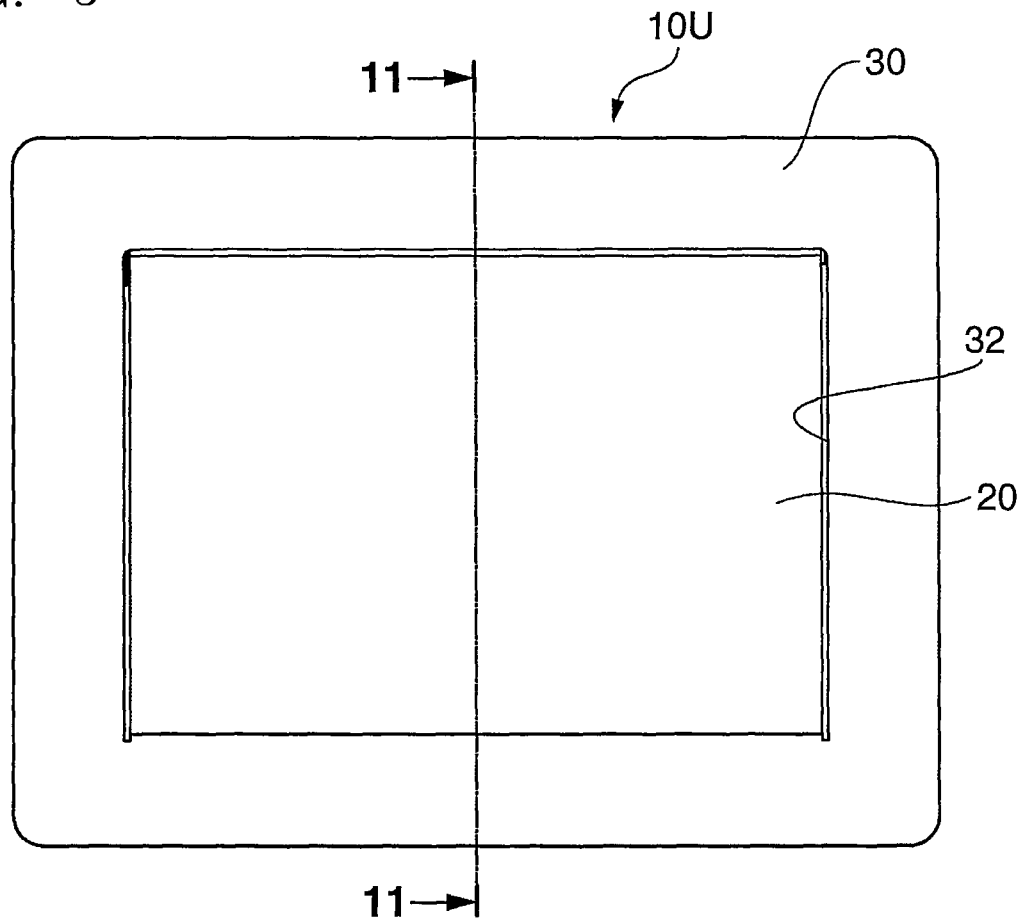
FIG. 5 is a front view of the pushing type lid opening/closing device to be attached to the dust box of FIG. 1.
Figure 6:
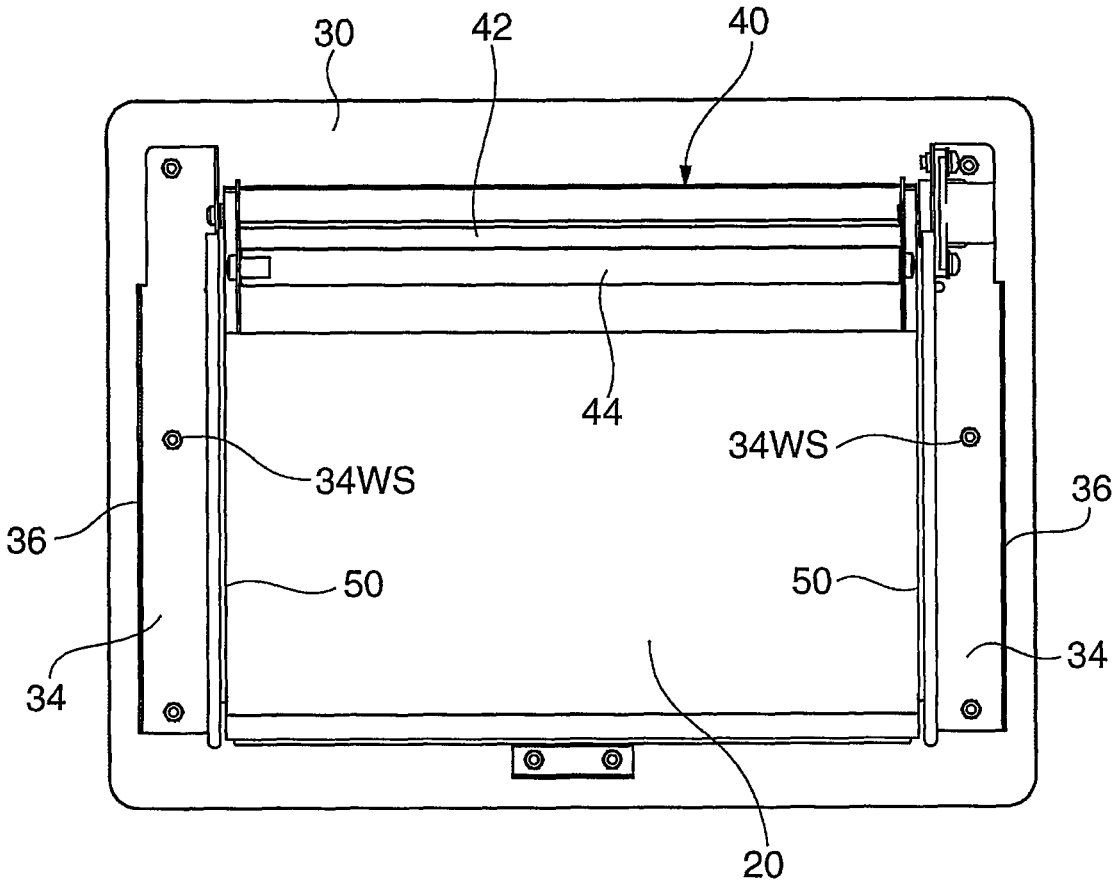
FIG. 6 is a back view of the pushing type lid opening/closing unit of FIG. 5.
Figure 7:
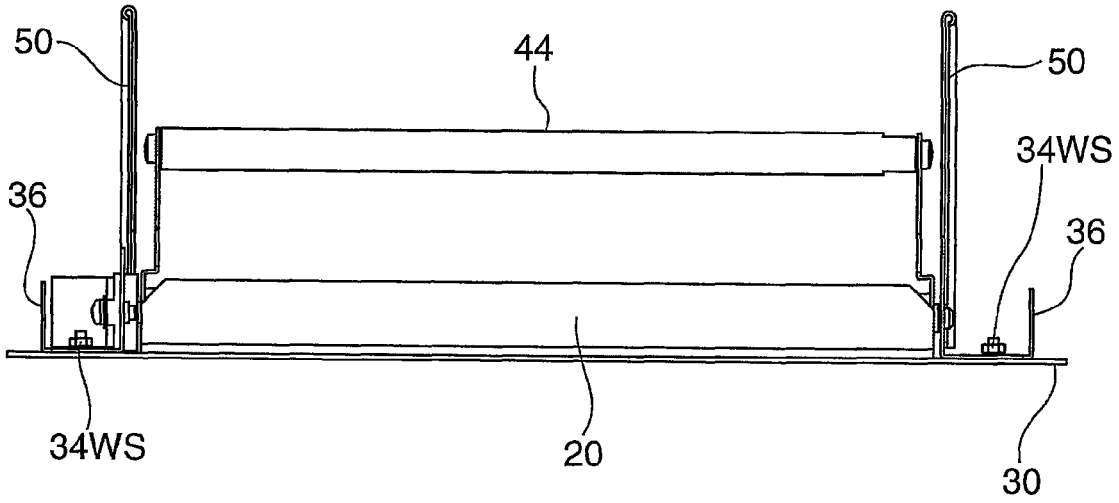
FIG. 7 is a top view of the pushing type lid opening/closing unit of FIG. 5.
Figure 8:
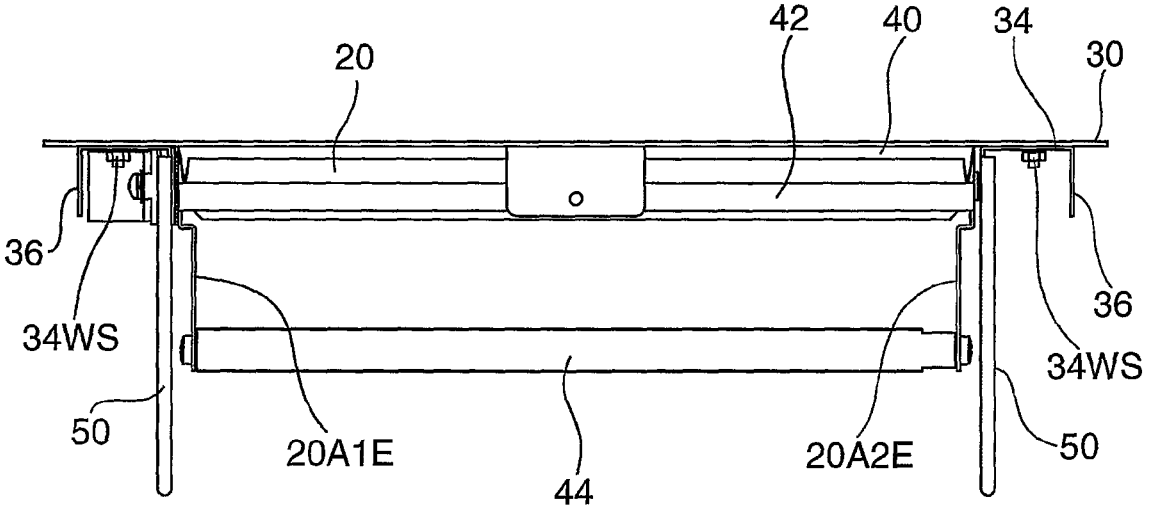
FIG. 8 is a bottom view of the pushing type lid opening/closing unit of FIG. 5.
Figure 9:
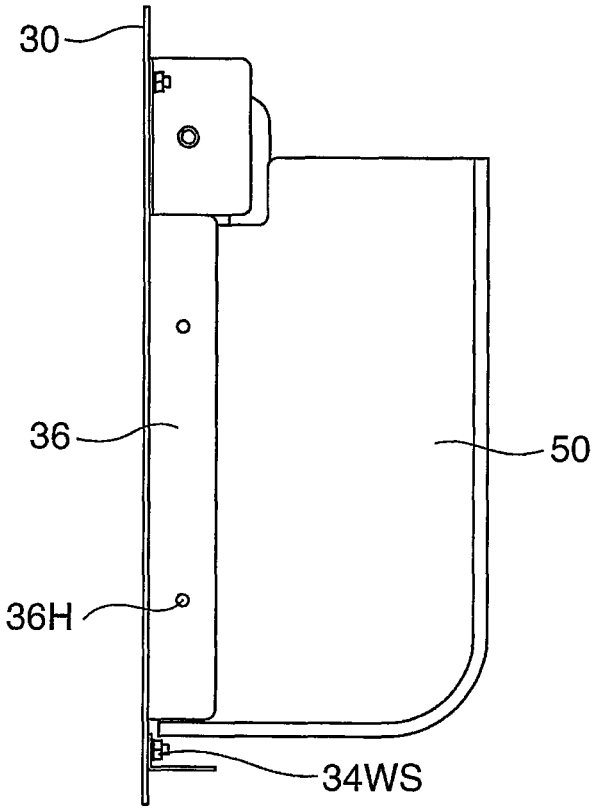
FIG. 9 is a right side view of the pushing type lid opening/closing unit of FIG. 5.
Figure 10:
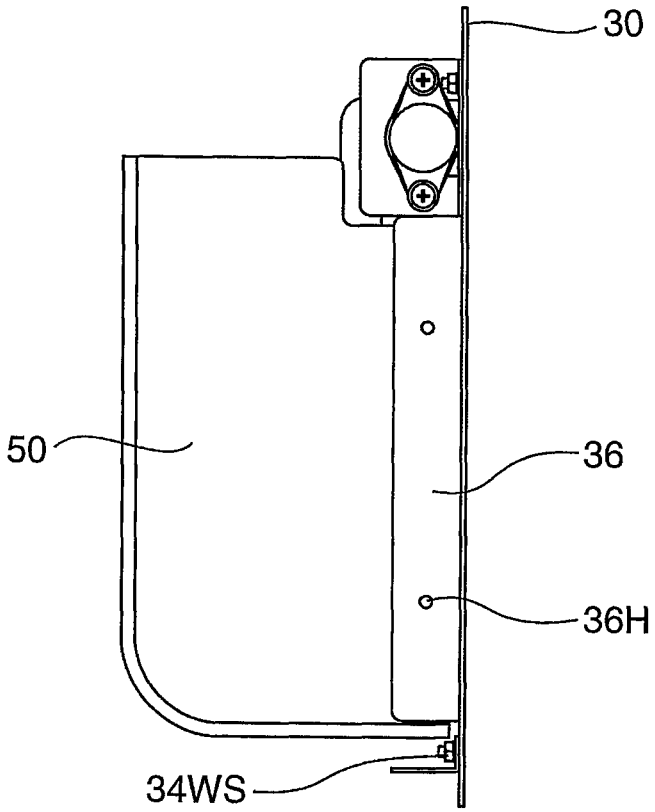
FIG. 10 is a left side view of the pushing type lid opening/closing unit of FIG. 5.
Figure 11:
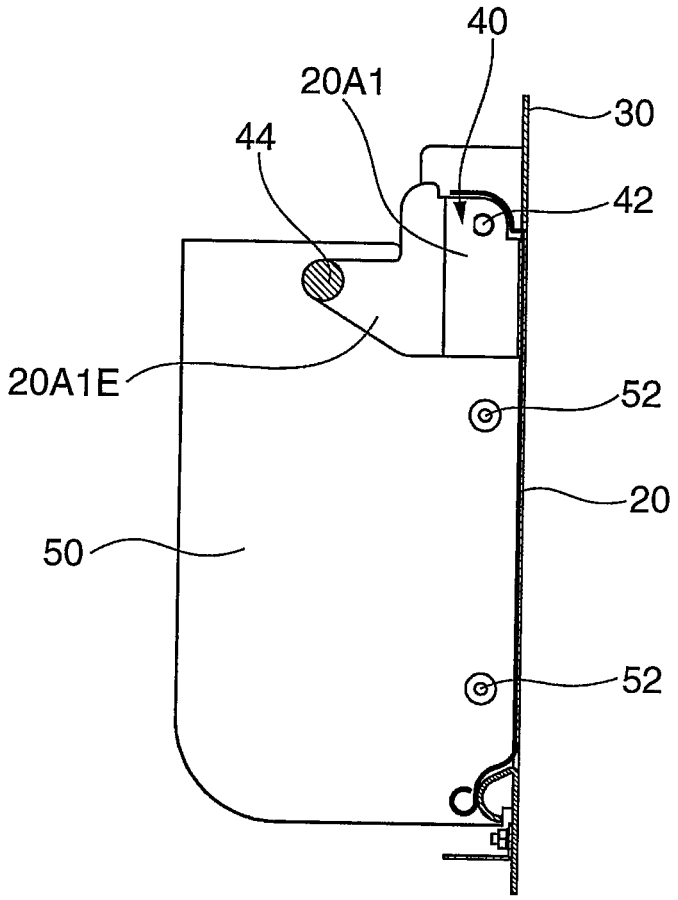
FIG. 11 is a cross sectional view of the unit taken along the line 11-11 of FIG. 5.
Figure 12:
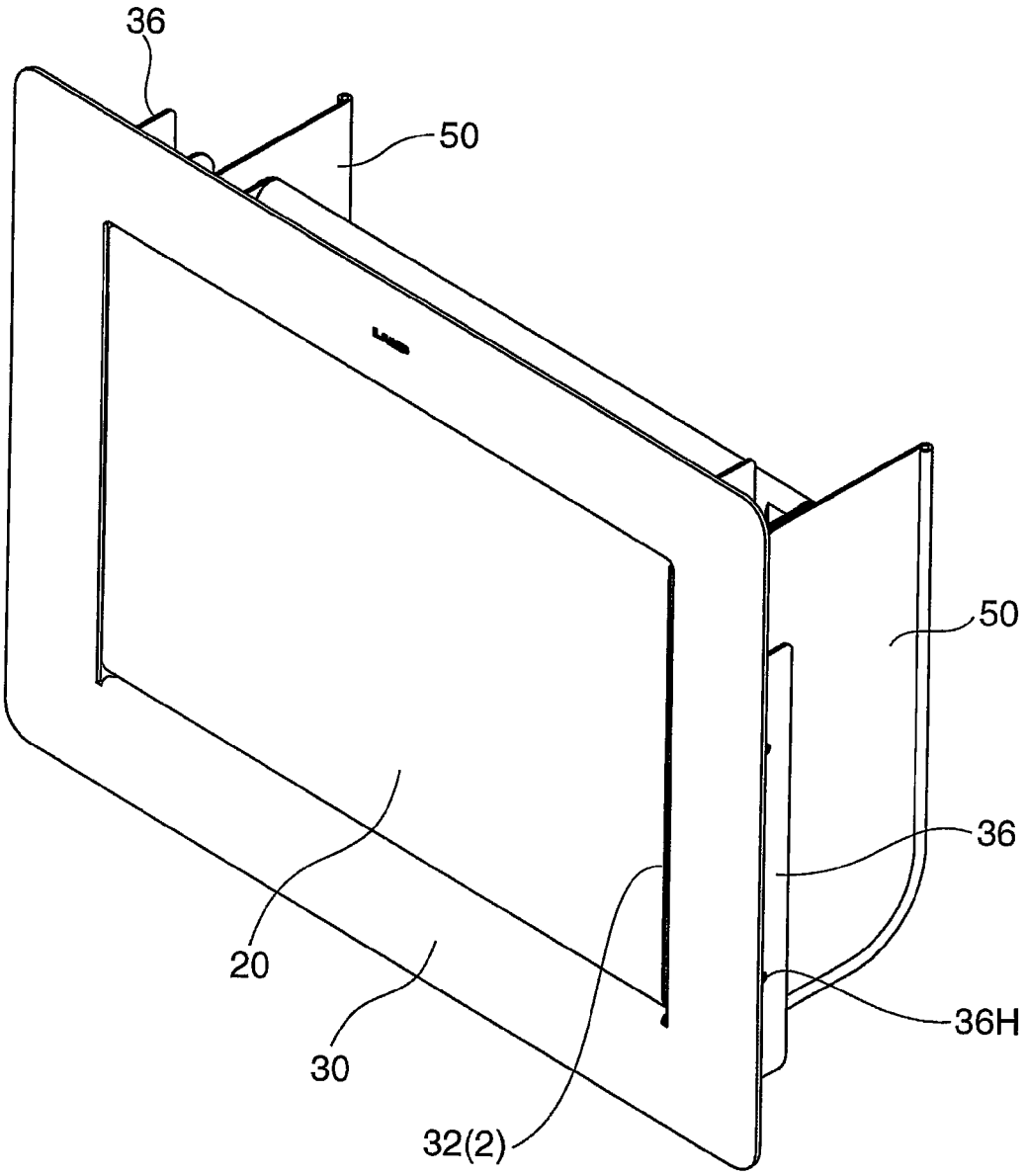
FIG. 12 is a front side perspective view of the pushing type lid opening/closing unit of FIG. 5.
Figure 13:
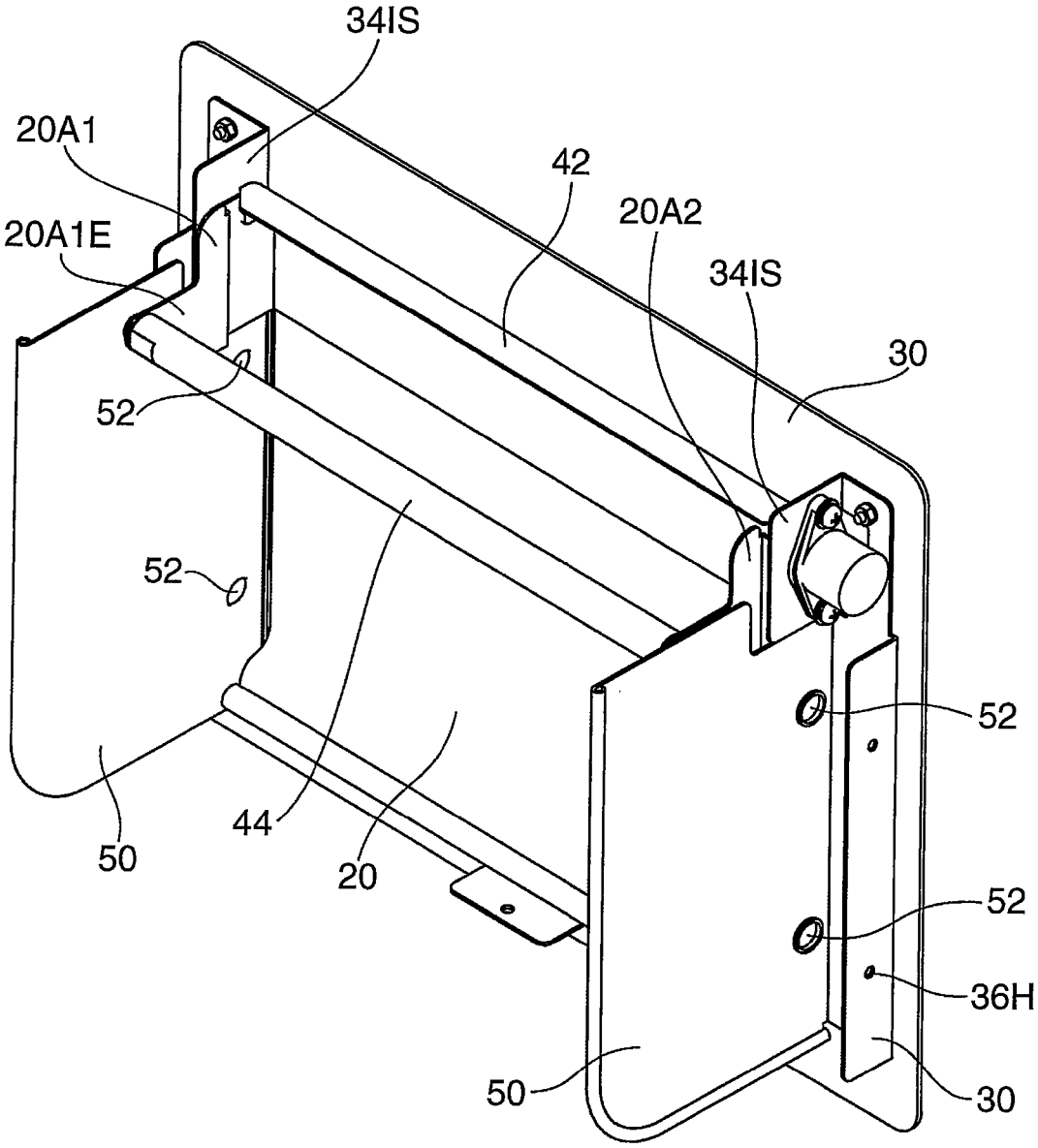
FIG. 13 is a back side perspective view of the pushing type lid opening/closing unit of FIG. 5.
Figure 14:
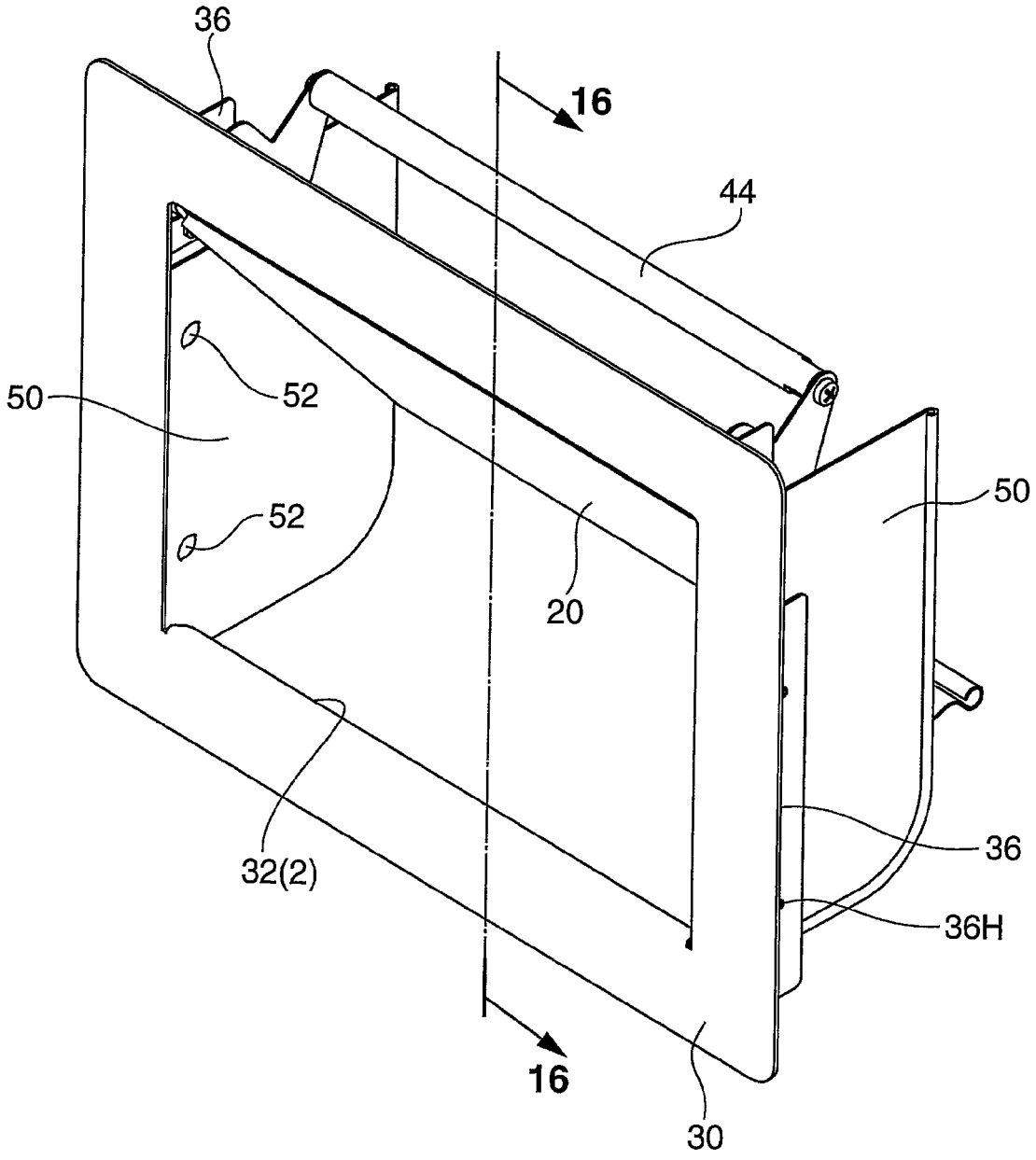
FIG. 14 is a front side perspective view of the pushing type lid opening/closing unit of FIG. 5 in the state where the lid is opened 40 degrees.
Figure 15:
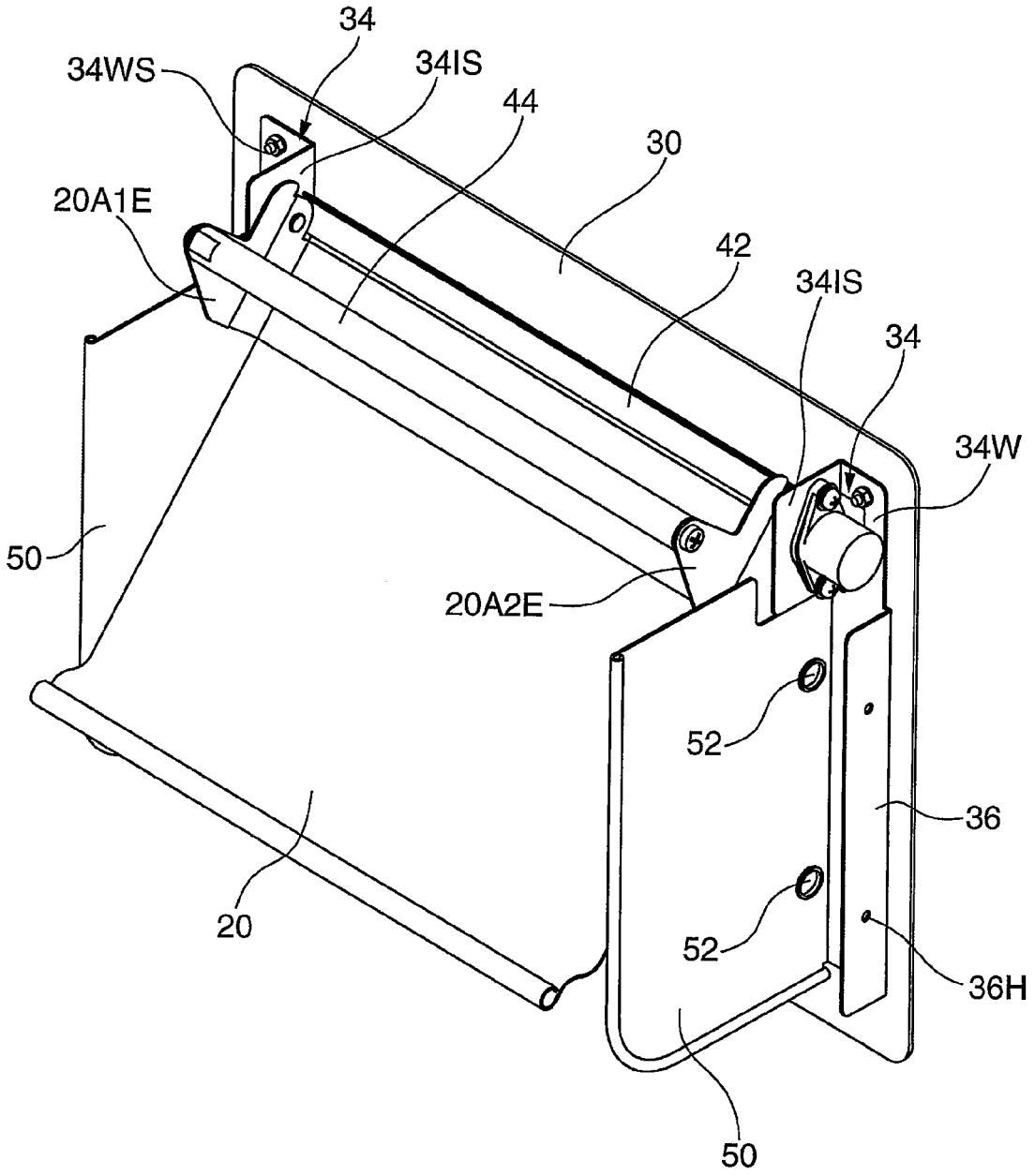
FIG. 15 is a back side perspective view of the pushing type lid opening/closing unit of FIG. 5 in the state where the lid is opened 40 degrees.
Figure 16:
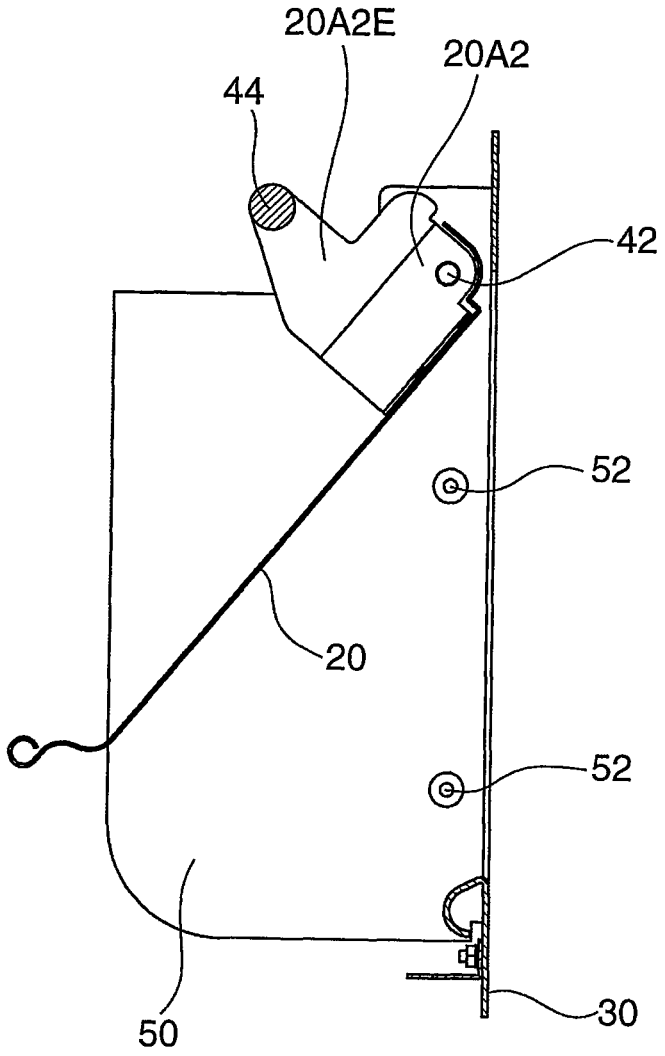
FIG. 16 is a cross sectional view of the unit taken along the line 16-16 of FIG. 14.
Figure 17:
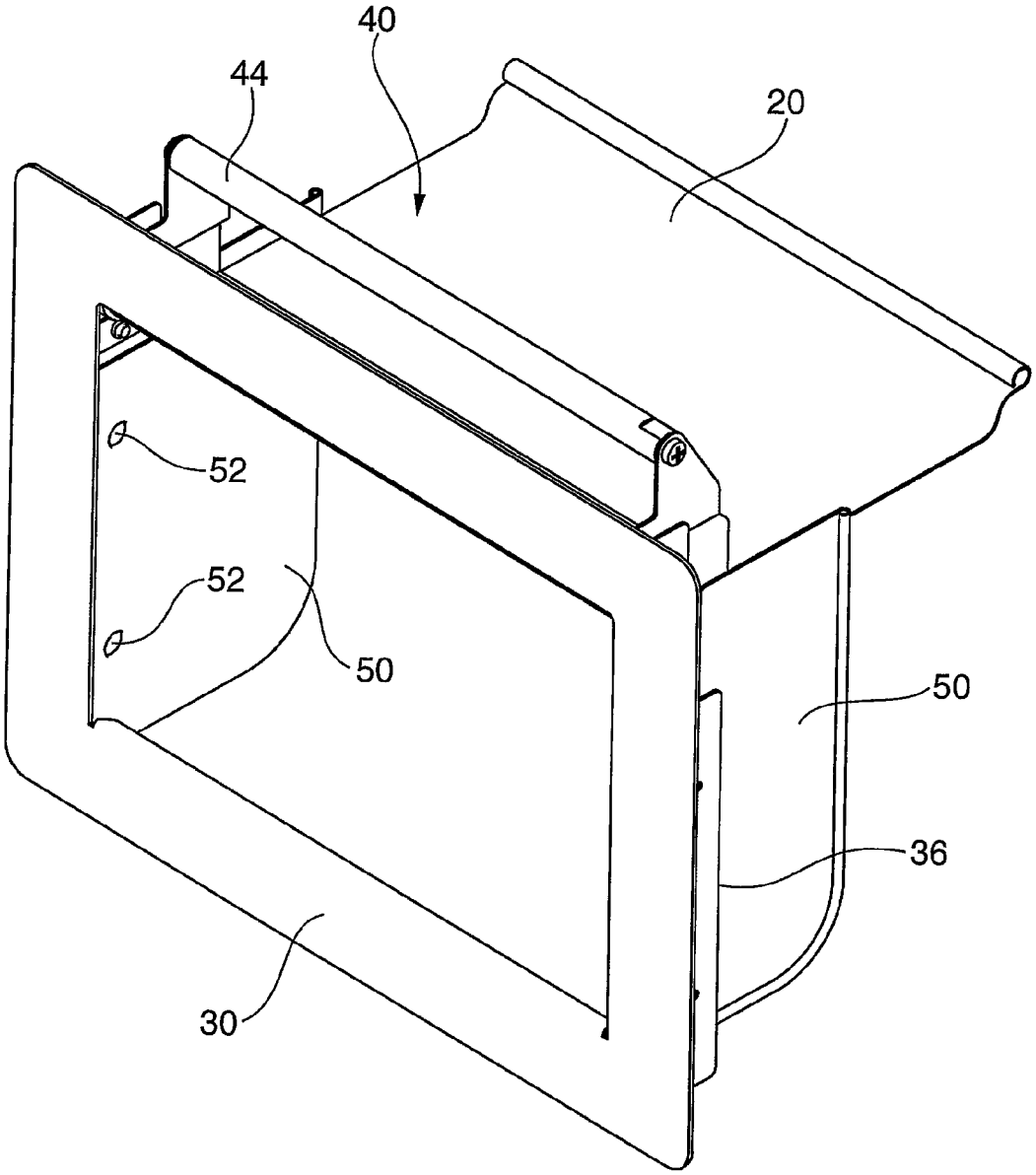
FIG. 17 is a front side perspective view of the pushing type lid opening/closing unit of FIG. 5 in the state where the lid is opened 90 degrees.
Figure 18:
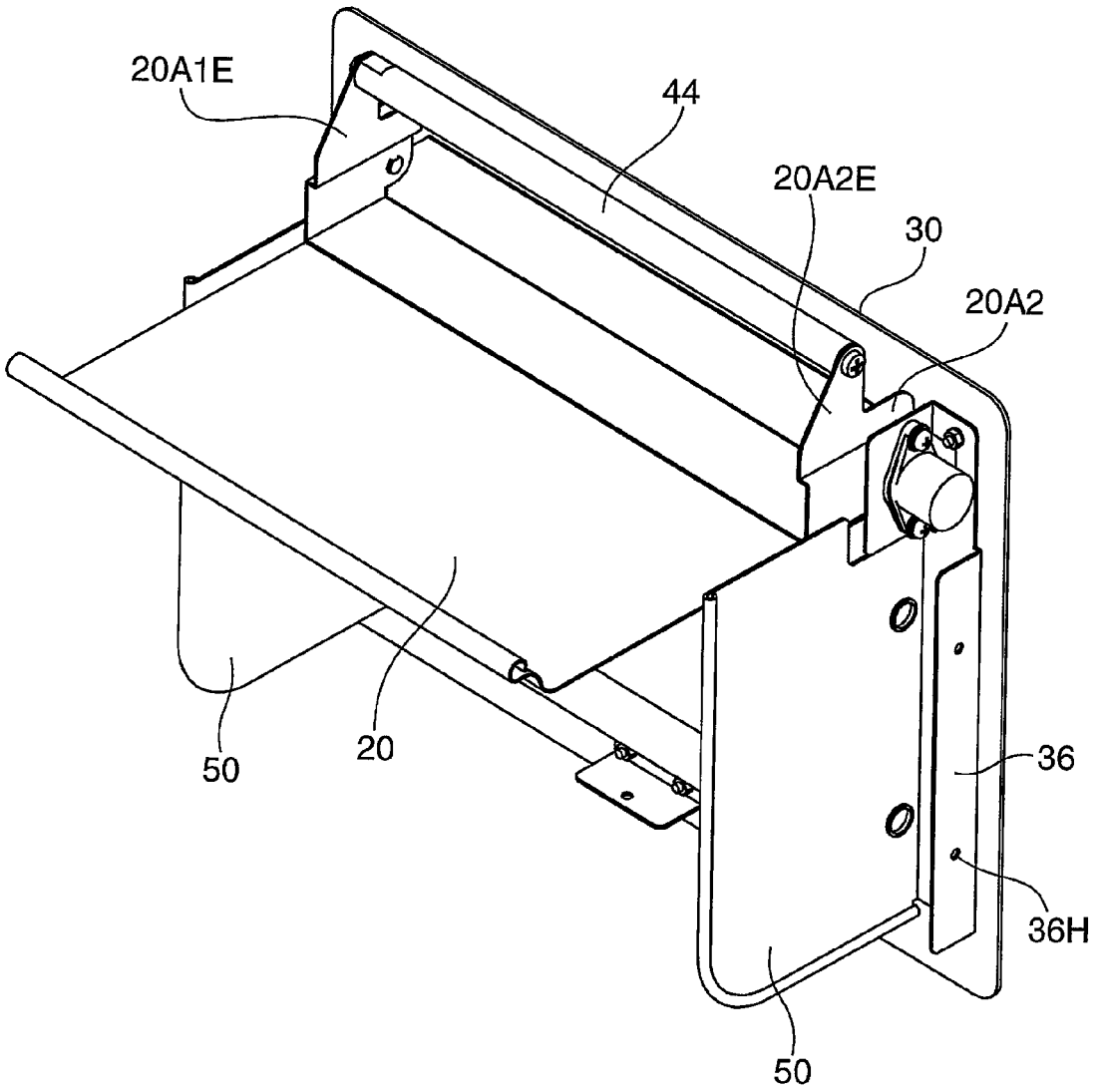
FIG. 18 is a back side perspective view of the pushing type lid opening/closing unit of FIG. 5 in the state where the lid is opened 90 degrees.
Figure 19:
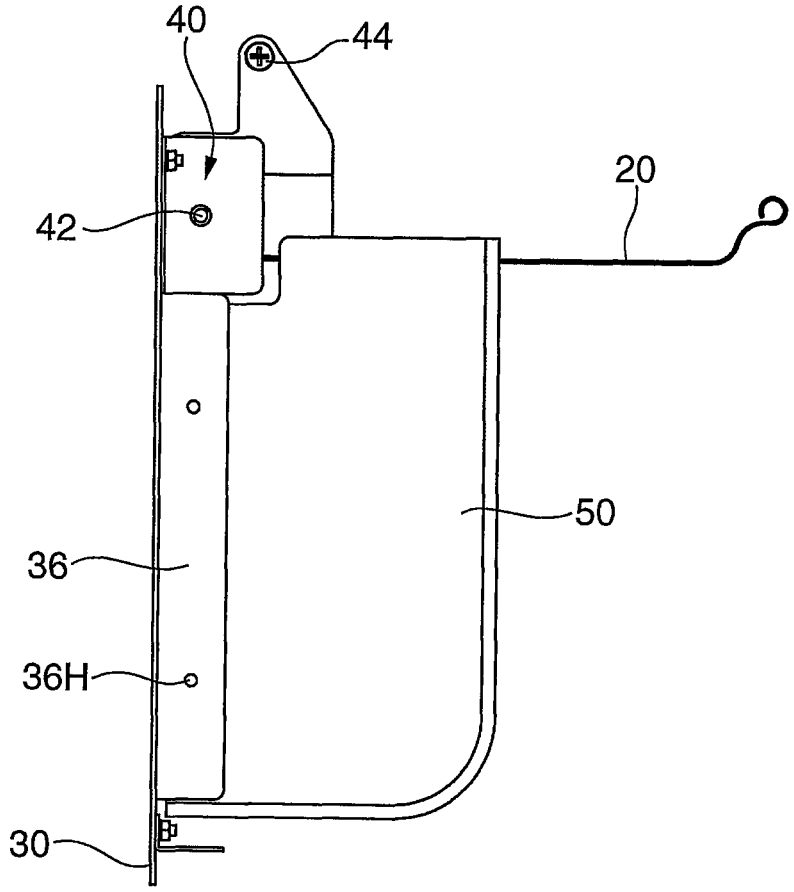
FIG. 19 is a right side elevational view of the pushing type lid opening/closing unit of FIG. 5 in the state where the lid is opened 90 degrees.

In the illustrated form, the attachment frame 30 has a pair of U-shaped attachment members 34 on the back face thereof and a web 34W of each of the attachment members 34 is securely attached to the back face of the attachment frame 30 by screws 34WS. An outside board of each of the attachment members 34 forms a screwing piece 36 securely attached to the inner wall face of the attachment port 1BH of the box body 1B by screws 36S as shown in FIG. 4. In FIGS. 9, 10, 13, 14, 15, 17 and 19, numerals 36H designate a screw penetration hole provided in the screwing pieces 36.

The lid pivotal support portion 40 comprises a pivotal support shaft 42 supported between the both inner side boards 34IS of the attachment member 34. The lid 20 has a pair of arms 20A1 and 20A2 on its upper side edge (see FIG. 13) and is pivotally supported on the pivotal support shaft 42 by the pair of arms 20A1 and 20A2 rotatably provided on the pivotal support shaft 42. In the illustrated form, a rod-like weight 44 may be mounted between triangular extensions 20A1E and 21A2E of the pair of arms 20A1 and 20A2 whereby the lid 20 is so urged that the opening 2 of the attachment frame 30 and the box body 1B is normally closed by the weight 44.

The lid opening/closing device of the invention is provided with a pair of hand and/or finger catch prevention wall members 50 so that a hand and/or fingers are never caught between the side edge 20E of the lid 20 and the side edge wall of the opening 32 of the attachment frame 30.

Figure 3:
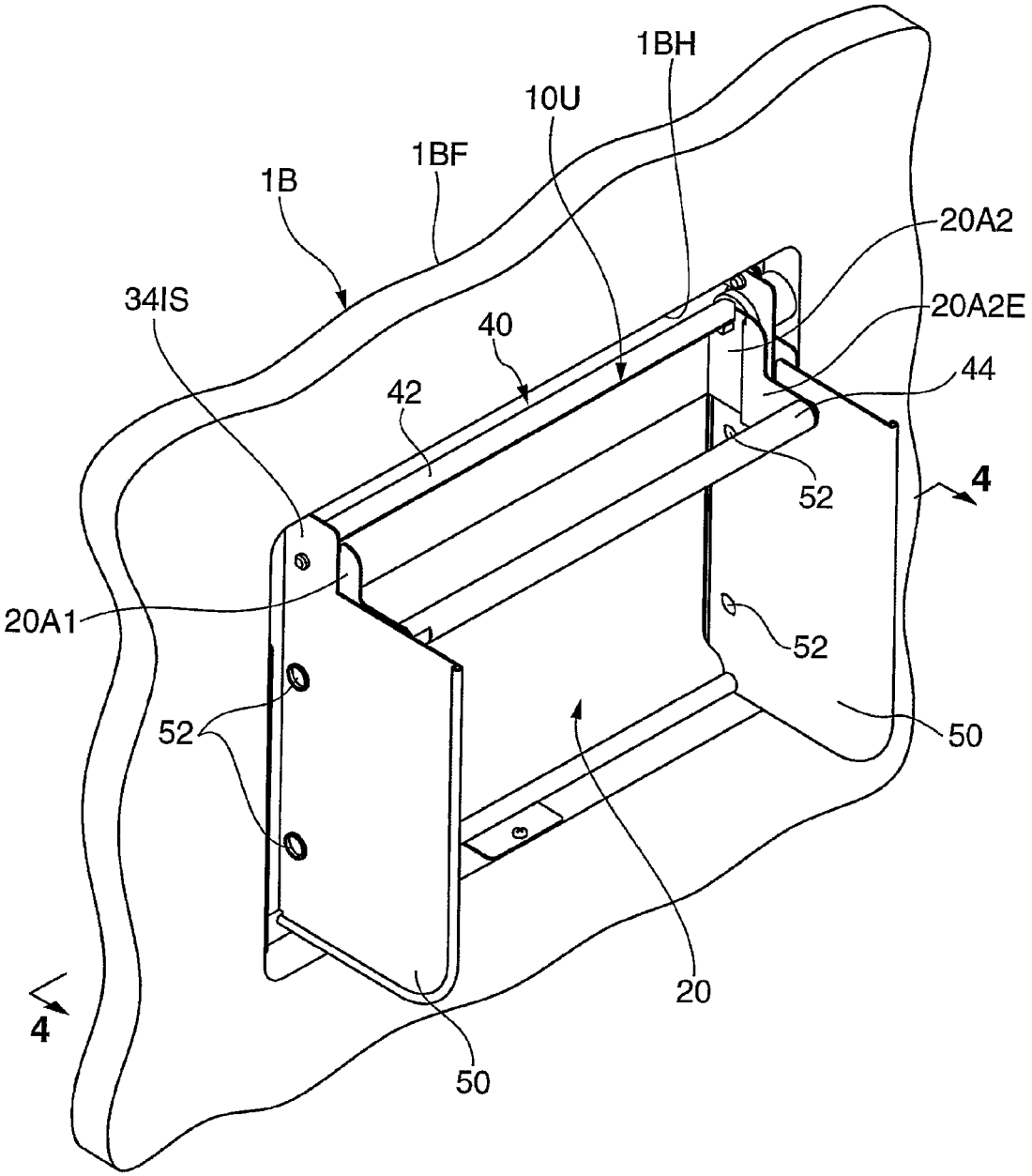
FIG. 3 is a partial and enlarged perspective view of a characteristic part of the pushing type lid opening/closing device of FIG. 1 in the state where it is viewed from inside.

In the illustrated form, the catch prevention wall members 50 extend integrally from the both side boards 34IS of the attachment member 34 as shown in FIGS. 3 and 4(B), but they may be attached to the both side boards 34IS by welding, adhesion, etc. As noted from FIGS. 4(A) and 4(B), the catch prevention wall members 50 extend from the front board 1BF of the container in a manner perpendicular relative to the board face of the front board 1BF, but they may extend in a manner where they are widened toward their leading ends unless the function of catch prevention of the hand and/or the fingers is reduced.

In addition thereto, the catch prevention wall members 50 may have a screw driver penetration holes 52 corresponding to the screw holes 36H of the screwing pieces 36. The screw driver penetration hole 52 is used for penetrating a screw driver for screwing the lid opening/closing unit 10U to the inner wall face of the attachment port 1BH of the box body 1B to screw the screwing pieces 36 to the inner wall face of the attachment port 1BH.

Although the hand and/or finger catch prevention wall members 50 may be desirably closer to the side edge 20SE of the lid 20 to such an extent that the hand and/or finger catch prevention wall members 50 never disturb the opening and/or closing of the lid 20 as shown in FIG. 4, there may be a gap G between them unless the fingers are caught between them relative to the side edge 20SE of the lid 20.

Next, the state where the container (the dust box) 1 having the pushing type lid opening/closing device 10 of the invention will be explained hereinafter. As shown in FIGS. 1, 5 through 13, the lid 20 is normally closed by the weight 44, but a person (a user) who is going to dump dust such as garbage etc. opens the lid 20 by manually pushing the lid 20 against the weight 44 about the lid pivotal support shaft 42 whereby the user can dump dust such as garbage etc. into the dust box 1. In the state where the lid 20 is opened is shown in FIGS. 14 through 19. Thereafter, when the user tries to release the hand from the lid 20 in order to close the lid 20, the hand or the fingers cannot enter the outside of the opening 2 beyond the side edge of the opening 20 in the box body 1B by the catch prevention wall members 50 and therefore the hand and/or the fingers are never caught between the side edge of the lid 20 and the side edge wall of the opening 2 with the result that the hand and/or the fingers can be positively removed out of the opening 2. Thus, it will be noted that the hand and/or the fingers of the user can be prevented from being caught between the lid 20 and the wall of the opening 2, which occurs in the dust box of the prior arts and the hand and/or the fingers are never damaged.

In case that the lid opening/closing device 10 is unitized, it is hard to screw the screwing pieces 36 to the wall of the opening 2 because the screwing pieces 36 to screw the lid opening/closing unit 10U to the inner wall face of the attachment port 1BH of the box body 1B is so positioned as to be close to the catch prevention wall members 50. However, since according to the lid opening/closing unit of the invention, a screw driver to drive the screw can penetrate the screw driver penetration hole 52 of the catch prevention wall member 50 to be able to access the screw 36S and therefore the lid opening/closing unit 10U can be easily attached to the box body 1B.

Figure 20:
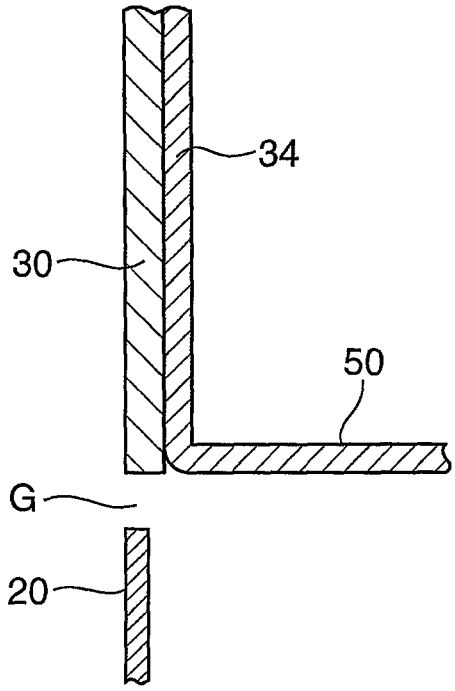
FIG. 20 is an enlarged cross sectional view of a portion of the device illustrating the relationship of position of the lid, the attachment frame and the hand and/or finger catch prevention wall member of FIGS. 1 through 19.

In the above-mentioned form of embodiment, the lid 20 is arranged to be close to the catch prevention wall members 50 to such an extent that the lid 20 never disturb the opening/closing of the lid 20, but as already described with reference to FIGS. 20 through 22, the lid 20 may be far away from the catch prevention wall members 50 via the gap G which the hand and/or the fingers can never enter.

In the above-mentioned form of embodiment, the catch prevention wall members 50 extend through the inside of the box body 1B so that the catch prevention wall members 50 are consistent with the inner face of the opening 32 (or 2) of the attachment frame 30 while the lid 20 is close to the side edge of the catch prevention wall members 50 (see FIG. 4), but a distance between the catch prevention wall member 50 and the lid 20 in a widthwise direction of the attachment frame 30 is so set as to be equivalent to or smaller than the distance between the sides edge wall face of the opening of the attachment frame 3 and the side edge of the lid 20.

Figure 21:
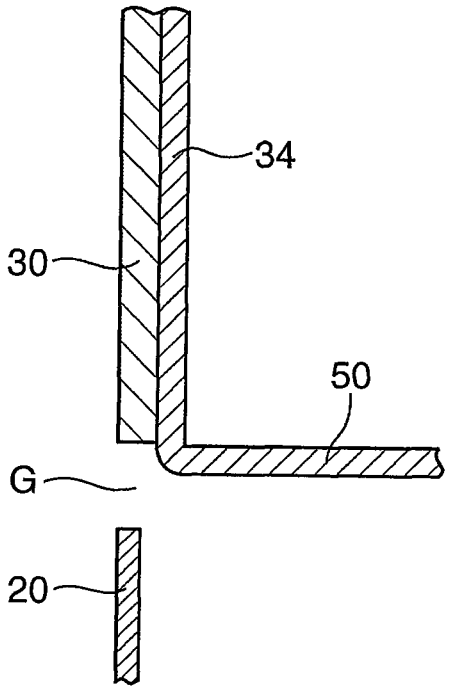
FIG. 21 is an enlarged cross sectional view of a portion of the device illustrating another relationship of position of the lid, the attachment frame and the hand and/or finger catch prevention wall member.

For instance, as shown in FIG. 21, the catch prevention wall members 50 may be positioned slightly inside of the inner face of the opening 32 (or 2) of the attachment frame 30 and in this case, the width of the lid 20 is required to be narrower so that both ends of the lid 20 are located similarly inside the opening 32 of the attachment frame 30 or further inside the catch prevention wall members 50 whereby the lid 20 never interferes with the catch prevention wall members 50 (see FIG. 21).

Figure 22:
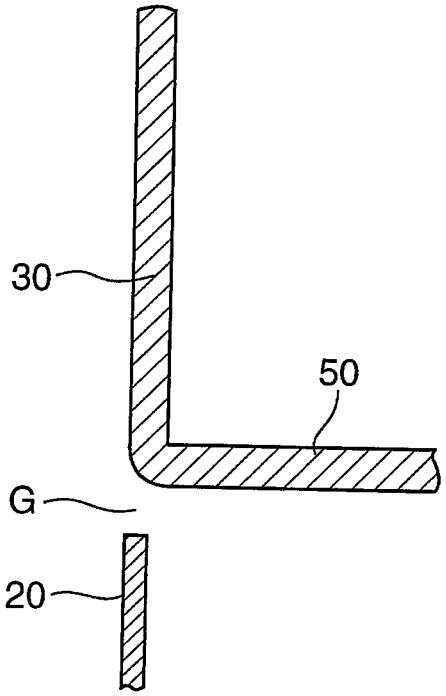
FIG. 22 is an enlarged cross sectional view of a portion of the device illustrating further relationship of position of the lid, the attachment frame and the hand and/or finger catch prevention wall member.

As shown in FIG. 22, the catch prevention wall members 50 may be formed integrally with the attachment frame 30 and in this case, the not shown screwing pieces 36 are required to be secured to the attachment frame 30 by a screw or welding.

Although, in the illustrated form, the pushing type lid opening/closing device 10 is formed by attaching the lid opening/closing unit 10U to the attachment port 1BH of the box body 1B, the device 10 may be so constructed that the attachment port 1BH itself of the box body 1B forms the opening 2 of the container 1 and the lid 20 is pivotally supported on the upper edge wall of the opening 2 and the catch prevention wall members 50 may be provided on the inner face of the front board 1BF of the box body 1B.

INDUSTRIAL APPLICABILITY

Since the lid opening/closing device of the invention is provided with the hand and/or finger catch prevention wall members to prevent the hand and/or the fingers from being caught between the lid and the wall face of the opening of the container or the opening of the attachment frame of the lid opening/closing unit attached to the attachment port of the container to form the opening of the container, the hand and/or the fingers are never caught between the lid and the wall face of the opening when the hand is released from the lid after it pushes the lid inwards and therefore, the hand and/or the fingers can be positively prevented from being caught between them and they are never damaged. Thus, the lid opening/closing device of the invention has a high industrial applicability.

What is claimed is:

1. A pushing lid opening/closing device of a container comprising said container and a lid pivotally supported adjacent to an opening of width smaller than a front board of a box body of said container and adapted to be opened by being manually pushed inwards and to be automatically closed when a hand is released from said lid whereby things are contained through said opening into said box body by manually pushing said lid, characterized in that said box body comprises an attachment frame with a flange to close a wall hole of said front board serving as an attachment port a pair of screwing pieces of L-shaped cross section each having a web secured to an inner face of said flange of said attachment frame, a lid pivotal support portion provided in an upper edge portion of an opening of said attachment frame to support said lid so that said lid pivotally moves about an upper edge of said lid and a total of two hand and/or finger catch prevention wall members each provided on both of said right and left sides of said attachment frame, respectively and disposed between said pair of screwing pieces in a manner parallel to said pair of screwing pieces to prevent a hand and/or fingers from being caught between said lid and a wall face defining said opening of said attachment frame, wherein said webs of said pair of screwing pieces each having said two hand and/or finger catch prevention wall members formed integral to said webs, respectively, and said pair of screwing pieces are mounted by screws to a wall face defining said wall hole of said front board within a space of said wall hole, that is within the thickness of said wall face defining said wall hole of said front board whereby heads of said screws are disposed in a spaced manner outwardly from said two hand and/or finger catch prevention wall members while said heads of said screws are faced to said two hand and/or finger catch prevention wall members between said pair of screwing pieces and said two hand and/or finger catch prevention wall members whereby said screws are positioned within an inside of said attachment frame so as not to be exposed to the outside by said attachment frame.

2. A pushing lid opening/closing device of a container as set forth in claim 1 and wherein a distance between said hand and/or finger catch prevention wall member and a side edge of said lid in the widthwise direction of said opening is set to be smaller than a distance between a side edge wall face of said opening and said side edge of said lid.

3. A pushing lid opening/closing device of a container as set forth in claim 1, wherein said two hand and/or finger catch prevention wall members have a screw driver penetration hole corresponding to said screw penetration hole of said screwing piece and said screw driver penetration hole is positioned within said wall hole serving as said attachment port.

4. A pushing lid opening/closing unit to be used for a pushing lid opening/closing device comprising a container and a lid to be pivotally supported adjacent to an opening of width smaller than a front board of a box body of said container and adapted to be opened by being manually pushed inwards and to be automatically closed when a hand is released from said lid whereby things are contained through said opening into said box body by manually pushing said lid, characterized in that said pushing lid opening/closing unit comprises an attachment frame with a flange to close a wall hole of said front board serving as an attachment port a pair of screwing pieces of L-shaped cross section each having a web secured to an inner face of said flange of said attachment frame, a lid pivotal support portion provided in an upper edge portion of an opening of said attachment frame to support said lid so that said lid pivotally moves about an upper edge of said lid and a total of two hand and/or finger catch prevention wall members each provided on both of said right and left sides of said attachment frame, respectively and disposed between said pair of screwing pieces in a manner parallel to said pair of screwing pieces to prevent a hand and/or fingers from being caught between said lid and a wall face defining said opening of said attachment frame, wherein said webs of said pair of screwing pieces each having said two hand and/or finger catch prevention wall members formed integral to said webs, respectively, said pair of screwing pieces are mounted by screws to a wall face defining said wall hole of said front board within a space of said wall hole, that is within the thickness of said wall face defining said wall hole of said front board whereby heads of said screws are disposed in a spaced manner outwardly from said two hand and/or finger catch prevention wall members while said heads of said screws are faced to said two hand and/or finger catch prevention wall members between said pair of screwing pieces and said two hand and/or finger catch prevention wall members whereby said screws are positioned within an inside of said attachment frame so as not to be exposed to the outside by said attachment frame.

5. A pushing lid opening/closing unit as set forth in claim 4 and wherein a distance between said hand and/or finger catch prevention wall members and a side edge of said lid in the widthwise direction of said attachment frame is set to be smaller than a distance between a side edge of said opening of said attachment frame and said side edge of said lid.

6. A pushing lid opening/closing unit as set forth in claim 4, wherein said two hand and/or finger catch prevention wall members have a screw driver penetration hole corresponding to said screw penetration hole of said screwing piece and said screw driver-penetration hole is positioned within said wall hole serving as said attachment port.

* * * * *